United States Patent [19]

Krautsack

[11] Patent Number: 4,839,977

[45] Date of Patent: Jun. 20, 1989

[54] MOUNTING CLIP FOR DISPENSING SHEET-LIKE ITEMS

[75] Inventor: Richard G. Krautsack, Arlington Heights, Ill.

[73] Assignee: Comark Merchandising, Inc., Elk Grove, Ill.

[21] Appl. No.: 159,828

[22] Filed: Feb. 24, 1988

[51] Int. Cl.[4] ..... G09F 3/20

[52] U.S. Cl. ..... 40/658; 40/650; 211/57.1

[58] Field of Search ..... 40/658, 650, 657, 617; 248/221.4, 222.2, 304; 211/54.1, 57.1, 59.1

[56] References Cited

U.S. PATENT DOCUMENTS

| | | | |
|---|---|---|---|
| 3,899,841 | 8/1975 | Berger | 40/658 |
| 4,179,138 | 12/1979 | Bogdanovic | 40/651 |
| 4,572,380 | 2/1986 | Langwell | 40/657 |
| 4,693,441 | 9/1987 | Conway | 248/221.4 |

*Primary Examiner*—Gene Mancene
*Assistant Examiner*—Cary E. Stone
*Attorney, Agent, or Firm*—Fitch, Even, Tabin & Flannery

[57] ABSTRACT

Enclosed is an assemblage for displaying and dispensing a plurality of sheet-like materials, one at a time. The assemblage can be mounted in a variety of both hanging and cantilever modes. The assemblage includes one or more stacks of sheet-like materials fastened to a clip which is stamped from a unitary flat blank of resilient material. The clip includes a pair of opposed arms joined to an intermediate base section with lines of weakness, each forming a hinge connection. A rivet fastener connects the stacks of sheet-like materials to both arms, while allowing one arm to slide relative to the other, such that the assemblage may be moved between collapsed and expanded configurations. A head portion extends from the base section and includes a pair of opposed, resiliently hinged ears. The ears may be cupped to fit within a pricing channel at an edge of a store shelf to provide one mode of mounting. The assemblage further includes an adhesive resilient pad attached to the base section to provide further variety in the number of possible mounting modes.

11 Claims, 1 Drawing Sheet

10
12
14
16
16a
18
18a
20
24
26
30
32
36
36a
36b
38
38a
38b
42
46
48
50
52
56
58
60
62
64
70
72
74
80
82
90

MOUNTING CLIP FOR DISPENSING SHEET-LIKE ITEMS

BACKGROUND OF THE INVENTION

1. Field of the Invention

The present invention relates to the display and also the dispensing of sheet-like materials, including sales materials such as refunds and rebates, and, in particular, relates to assemblages for displaying and/or dispensing sales materials in a manner which attracts customers' attention to a featured item in a store, as customers approach a shelf upon which the item can be found.

2. Description of Prior Art

Sales coupons or other messages announcing price discounts and other promotional information, such as recipe suggestions, are sometimes located on displays positioned near or on a shelf where the promotional item can be found. These messages typically appear either on signs mounted across the front of the shelf, or on single-layer placards outwardly projecting from the shelf, toward the center of the aisle. Signs or placards made of flexible material extending outwardly from the shelf are incorporated in assemblages which are typically held along a side margin of the shelf by a rigid bracket mounted thereto. There is, however, a need for mounting multiple sheets of promotional material so that the outermost sheet of the promotional material is positioned next to the featured item and is readily visible to a customer entering the aisle in a direction approaching the featured item. A particular advantage are realized if short-term discount refunds can be located immediately adjacent the featured item, rather than located at a remote location in the store, such as a customer service center, as is frequently the case. By their nature, discount refunds, suggested recipes and the like are most effective if distributed one sheet at a time, providing individual copies of the promotional materials to interested customers.

SUMMARY OF THE INVENTION

Accordingly, it is an object of the present invention to provide an assemblage for mounting and dispensing multiple sheets of promotional material in a manner which also displays the sheets so as to direct customer attention to the promotional material.

A further object of this invention is to provide a mounting clip which, when joined to multiple sheets of promotional material, positions the material in full view of customers approaching a spot on a shelf where items featured in the material are located.

Still another object of the present invention is to provide a clip for mounting multiple sheets of promotional material which is comprised of a minimum number of inexpensive parts and which can be readily reconfigured to provide a number of different mounting modes.

Additional objects and advantages of the present invention will be apparent from the following detailed description of certain preferred embodiments thereof which proceeds with reference to the accompanying drawings.

These and other objects of the present invention are provided in an apparatus which displays and dispenses a plurality of sheet-like materials, one at a time, from a stack of such materials. A unitary strip of flexible material defines a pair of opposed arms and a base section intermediate the arms and having a rear surface. Fastener means connect the stack of sheet-like materials to both arms, allowing one arm to slide relative to the other arm. Thus, the base means is selectively movable from a position generally parallel to the stack of sheet-like materials to a position where the rear surface of the base faces generally away from the stack. The base is mounted to an external support whereby the stack of sheet-like materials is supported as individual sheet-like components of the stack are separated therefrom.

BRIEF DESCRIPTION OF THE DRAWINGS

In the drawings, wherein like elements are referenced alike.

DETAILED DESCRIPTION OF THE PREFERRED EMBODIMENT

Figures 1, 2, 3, 4, 5, 6, 7:
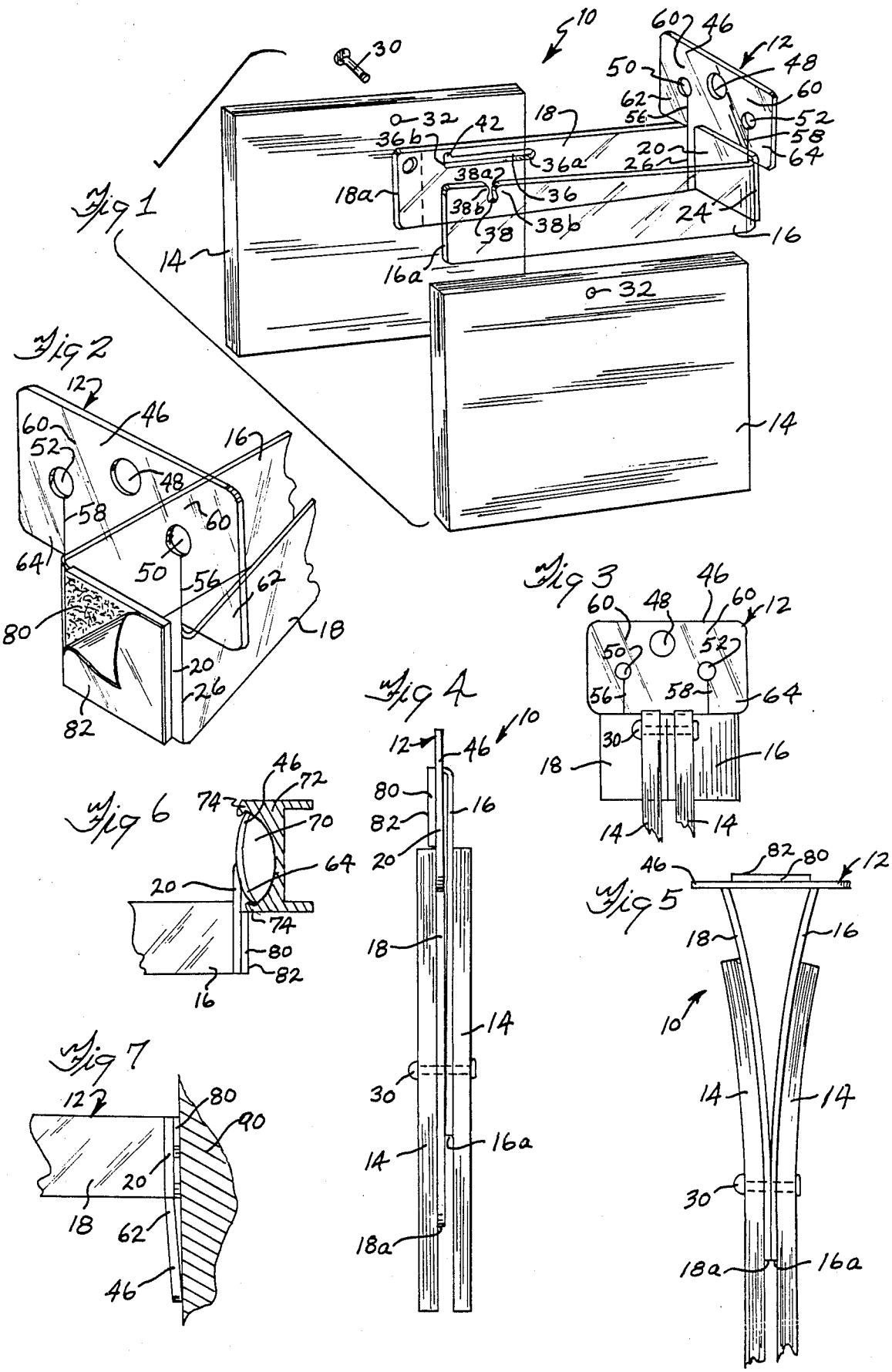
FIG. 1 is an exploded perspective view of an assemblage according to the present invention for mounting, displaying and dispensing stacked sheets of promotional material.
FIG. 2 is a fragmentary perspective view of the mounting clip of FIG. 1.
FIG. 3 is an end elevational view of a fully assembled arrangement of the mounting clip and stacked sheets of FIG. 1.
FIG. 4 is a top plan view of the arrangement of FIG. 3 shown in a collapsed position.
FIG. 5 is a top plan view of the arrangement of FIG. 3 shown in an expanded position.
FIG. 6 is a fragmentary elevational view, taken partly in cross-section, of the arrangement of FIG. 5 shown mounted in a price tag channel at an outer edge of a shelf.
FIG. 7 is a side elevational view of the assembly of FIG. 5 shown mounted to a wall surface by an adhesive pad.

Referring now to the drawings, there is illustrated an assemblage 10 for mounting, displaying and dispensing of sheet-like items 14, one at a time. Assemblage 10 includes a mounting clip, generally indicated at 12, joined to two stacks of sheet-like materials 14, such as coupons, recipes, or other promotional material. If desired, one of the stacks of materials 14 illustrated in the Figures can be omitted. Mounting clip 12 includes a pair of generally coextensive, elongated arms 16, 18 extending from opposite sides of an intermediate base 20, and joined thereto at fold lines 24, 26. Fold lines 24, 26 define lines of weakness joining the arms 16, 18 to base 20, allowing a folding between the arms and base 20. Arms 16, 18 have opposed free ends **16*a*, 18*a***.

Preferably, mounting clip 12 is formed from a unitary blank of resilient sheet material, such as plastic or the like. A rivet or the like fastener 30, which passes through a hole 32 in each stack, secures the stacks of materials 14 to both arms 16, 18. Preferably, rivet fastener 30 is received in a slot 36, elongated along the longitudinal axis of arm 18, and is also received in a slot 38 formed in arm 16 adjacent the free end thereof so as to extend to the arm's upper edge. Slot 38 has an opening **38*a* of reduced size at the upper edge of the arm, and the slot is preferably dimensioned to receive rivet fastener 30 with a relatively close fit. The opening 38*a* formed by opposed camming edges 38*b* is of reduced size, not sufficiently large to freely allow the rivet fastener to pass therethrough. With mounting clip 12 formed from a resilient material such as plastic, the arm 16 can be deformed with finger pressure to enlarge the opening 38***a* as rivet fastener 30 is forced through opening 38*a*, thereby freeing fastener 30 from arm 16. However, even with the separation of fastener 30 from arm 16, the stacks of materials 14 remain securely fastened to the other arm 18 to achieve advantages as will be indicated below.

Slot 36 has an inner end 36*a* adjacent base 20 and an outer end 36*b* adjacent the free end 18*a* of arm 18. A recess 42 extends laterally from slot 36 to provide a detent or locking position for fastener 30 at the outer end 36*b* of slot 36, for reasons which will become apparent herein.

Referring to FIGS. 1 and 3, and especially to FIG. 2, clip 12 includes a head 46 which extends outwardly from base 20 to provide several modes of mounting the arms 16, 18. Preferably, head 46 is integrally formed with the arms 16, 18 and base 20 of clip 12. As shown most clearly in FIG. 2 body portion of head 46 is generally coextensive with the base portion 20, generally forming an upward extension thereof. Ears 62, 64 extending beyond the lateral edges of base 20, are provided at the lateral edges of head 46. Ears 62, 64 are preferably cutting head 46 along lines 56, 58. As shown in FIG. 2, the cut lines 56, 58 may be formed as extensions of fold lines 24, 26, although such alignment is generally not required. The cut lines 56, 58 are preferably terminated in stress-relief holes 50, 52, to provide hinge connections 60 for joining ears 62, 64 to the central body portion of head 46. A mounting aperture 48 is formed in head 46, centrally located between strain-relief apertures 50, 52 and lying between the hinge portions 60 connecting ears 62, 64 to the central body portion of head 46.

It can thus be seen that mounting clip 12 can be simply and inexpensively formed by stamping an integral plastic blank in a single operation. When so formed, head portion 46 and base portion 20 preferably lie in the same plane.

According to some aspects of the present invention, clip 12 can be configured in a number of different ways for mounting one or more stacks of promotional materials. For example, the clip 12 can be configured for cantilevered mounting as illustrated in FIGS. 1–3 and 5–7. A nail, thumbtack, or the like fastener can be received in mounting aperture 48 to provide one mode of mounting the assemblage 10. If desired, additional support can be provided by inserting additional fasteners through the strain-relief aperture 50, 52, although such is generally not required.

At times, a support surface suitable for receiving a nail or thumbtack fastener is not available for the cantilever mounting of assemblage 10. Accordingly, with reference to FIG. 2, the surface of base 20 facing away from arms 16, 18 is provided with an adhesive, resilient pad 80 having an outer cover sheet 82. With cover sheet 82 removed, the adhesive surface of pad 80 is exposed for cantilever mounting the assemblage to a support wall 90, as illustrated in FIG. 7. Although assemblage 10 can be mounted with the upright orientation illustrated in FIG. 1, it is generally preferred, when using adhesive mounting pad 80, that the mounting clip 12 be inverted so that head 46 thereof points in a generally downward direction. Head 46, as illustrated in FIG. 7, is preferably arranged to contact wall 90 to augment the cantilevered mounting of arms 16, 18. The stacks of materials 14 are free to pivot about fastener 30 to preserve the desired upright orientation of indicia printed thereon, as clip 12 is moved between upright and inverted positions.

Referring to FIG. 6, assemblage 10 may be mounted to the outer edge of a shelf 72, having a "pricing channel" 70 formed between upper and lower marginal ridges 74. The ears 62, 64, as illustrated in the side view of FIG. 6, may be displaced from the plane of base 20, allowing the ears to be cupped or bent in a generally arcuate configuration, so as to be receivable in a channel 70 of reduced height relative to the height of head 46. When formed of plastic material, ears 62, 64 provide the resilience necessary for a biased retention of mounting clip 12 in pricing channel 70. Strain-relief apertures 50, 52 prevent undesired tearing of head 46 which would weaken or separate the ears from the central body portion of the head, and also aid in defining the hinge portions 60 which facilitate the bending or twisting of ears 62, 64 away from base 20.

Referring now to FIG. 4, the assemblage constructed according to principles of the present invention may be collapsed to provide an improved, compact, low-profile configuration suitable for storing and shipping prior to installation at a desired location. As illustrated in FIG. 4, arms 16, 18, as well as head 46 and base 20, all lie parallel to arms 16, 18 and stacks 14, in a closely-packed configuration. Arm 16 is bent approximately 180° from its initial position when the integral blank is formed by stamping. When so bent, arm 16 overlies base 20 and is in intimate contact therewith. As indicated in FIG. 4, fastener 30 maintains an intimate engagement between arms 16, 18 and the stacks of materials 14, the fastener, as explained above, being received in the elongated slot 36 of arm 18 and the slot 38 of arm 16.

If desired, assemblage 10 can be mounted in the "flat" configuration of FIG. 4, either with the adhesive pad 80 or with nail, thumbtack or pegboard fasteners received in any of the apertures 48, 52. Alternatively, if desired, arm 16 can be moved in a direction transverse to its length, forcing the passage of fastener 30 through the reduced opening 38*a* adjacent the free end of the arm. This allows arm 16 to be folded away from the plane of the flat shipping package of the assemblage, to assume any angle relative thereto desired for mounting. In particular, arm 16 can be extended to point away from the stacks of materials 14 and a thumbtack or the like fastener can be received in aperture 38 to hang the assemblage from the outer, free end of arm 16.

Referring again to FIG. 4, it will be noted that the free ends 16*a*, 18*a* of arms 16, 18 are displaced one from another. In order to assume the expanded configuration of FIG. 5, arms 16, 18 must be oriented generally perpendicular to base 20, with the free ends 16*a*, 18*a* of the arms lying generally next to each other. This change in configuration from the closed configuration of FIG. 4 to the open configuration of FIG. 5 is achieved in part by folding or bending arms 16, 18 at their fold lines 24, 26. However, as will now be appreciated, arm 18 must be free for sliding movement relative to arm 16. Accordingly, slot 36 is preferably elongated in the direction of the longitudinal axis of arm 18, being extended from a point of registry with slot 38, toward base 20. When shipped or otherwise stored in the closed configuration of FIG. 4, fastener 30 is initially located adjacent the inner end 36*a* of slot 36, that end closest to base 20. When clip 12 is reconfigured in the open position of FIG. 5, arm 18 is, in effect, moved relative to fastener 30 so as to bring the fastener to the outer end 36*b* of slot 36, that end adjacent the free end 18*a* of the arm.

As will be appreciated by those skilled in the art, when clip 12 is formed from an integral sheet-like blank of resilient plastic material, and is stored for long periods of time in the closed position of FIG. 4, arm 18 might experience a restoring force which would bring fastener 30 inwardly, away from its desired position at the outer end 36*b* of slot 36. Accordingly, a transverse slot 42 is provided to lock fastener 30 at the outer end 36*b* of slot 36 to maintain the clip 12 in the open or expanded configuration illustrated in FIG. 5. The transverse recess 42 is generally preferred, in that it can accommodate the rivet fastener 30, and requires no adjustment by a user.

However, if desired, recess 42 can be omitted if fastener 30 is provided with a selective clamping of the arms 16, 18. For example, fastener 30 could comprise complementary screw and nut-like fastener members inserted in arms 16, 18 after the construction of assemblage 10 is completed. When shipped with closed configuration of FIG. 4, the nut fastener can be released, allowing any movement between arms 16, 18, that may be necessary. Thereafter, when ready for mounting, the arms can be shifted and locked in the open configuration illustrated in FIG. 5, with subsequent tightening of the screw fastener maintaining the arms in their indicated positions. Other arrangements for securing arms 16, 18 and stacks 14 are, of course, possible and are contemplated by the present invention.

It can therefore be seen that an assemblage of a clip and one or more stacks of sheet materials has been provided for displaying and dispensing individual sheets of the materials. The assemblage is movable between collapsed and expanded configurations, with a pair of generally coextensive mounting arms sliding one over the other. An elongated slot is provided in one arm and preferably has an end aligned in registry with a slot in the other arm when the assemblage is configured in the expanded position. Upon reconfiguring the assemblage to a collapsed position, the fastener slides in the elongated slot, while at all times maintaining an interconnection of the stacks of sheet materials and the mounting arms.

The assemblage, as has been shown, can be mounted in a variety of different hanging and cantilever positions. In the hanging positions, the assemblage can be mounted with thumbtacks, or pegboard hooks, or an adhesive pad provided with the assemblage. The arms can be maintained in an overlying position, or one of the arms can be separated from the rivet fastener and unfolded, so as to extend away from the sheet materials, thereby providing a strap of extended length from which the sheet materials may be suspended. Also, the assemblage, with a minimal amount of manipulation, can be reconfigured for a variety of cantilever mountings using a thumbtack, pegboard hook, an adhesive pad provided with the assemblage, or a price channel located at the outer edge of a store shelf. Further, the central head portion of the mounting clip can be bent at a right angle to the arms of the clip, for securement to a horizontal surface of a shelf, using a thumbtack or the like fastener. The ears located on each lateral side of the head are resiliently deformable so as to be receivable in the ridges of a pricing channel.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. Apparatus including a clip for displaying and dispensing a plurality of sheet-like materials, one at a time, and at least one stack of sheet-like materials, comprising:

a plurality of sheet-like materials arranged in a stack;

a clip which includes a unitary strip of flexible material defining a pair of opposed arms and a base section intermediate the arms and having a rear surface;

fastener means for connecting the stack of sheet-like materials to both said arms so as to allow one said arm to slide relative to the other so that said base section is selectively movable from a position generally parallel to said stack of sheet-like materials to a position wherein the rear surface of said base section faces generally away from said stack of sheet-like materials; and said clip further includes mounting means for mounting said base section to an external support means whereby said stack of sheet-like materials is supported a individual sheet-like components of the stack are separated therefrom.

2. The apparatus of claim 1 further comprising head means extending outwardly from said base section, said head means including said mounting means.

3. The apparatus of claim 2 wherein said mounting means comprises an aperture in said head means for receiving a fastener which mounts said apparatus to an external support surface.

4. The apparatus of claim 2 wherein said mounting means comprised a resilient pad on said rear surface and having an adhesive surface covered by a selectively removable cover sheet.

5. The apparatus of claim 4 wherein said head means is formed from a portion of said unitary strip of flexible material.

6. The apparatus of claim 5 wherein said unitary strip defines lines of weakness joining said arms to said base section, rendering the arms foldable with respect to said base section.

7. The apparatus of claim 2 wherein said head means has a pair of opposed ears formed therein, with cut lines defining hinge portions joining the ears to a central portion of said head means.

8. The apparatus of claim 1 further comprising a second stack of sheet-like items spaced from said stack by at least one said arm and joined to at least one said arm by said fastener means.

9. The apparatus of claim I wherein one of said arms contains an elongated slot for receiving said fastener means, said slot permitting said fastener means to slide therein while being retained captive within said slot.

10. The apparatus of claim 7 wherein said fastener means comprises a rivet, and the other of said arms includes an edge defining a recess between a pair of camming surfaces for selective snap engagement with said rivet, whereby said other arm, when disengaged from said rivet, can be folded about said base section so as to extend away from said stack of sheet-like materials.

11. The apparatus of claim 10 wherein said slot includes a lateral recess extending from said slot proportioned to receive said rivet so as to maintain said one arm in a slidingly extended position relative to said other arm when said rivet is engaged in said recess, in which position said base section rear surface faces generally away from said stack of sheet-like materials.

* * * * *

UNITED STATES PATENT AND TRADEMARK OFFICE

CERTIFICATE OF CORRECTION

PATENT NO. : 4,839,977

DATED : June 20, 1989

INVENTOR(S) : Richard G. Krautsack

It is certified that error appears in the above-identified patent and that said Letters Patent is hereby corrected as shown below:

Column 3, line 18, after "FIG. 2" insert --, the central--.

Column 3, line 23, after "preferably" insert --formed by--.

Column 5, line 19, after "with" insert --the--.

Column 6, line 23, change "a" to --as--.

Column 6, line 33, change "comprised" to --comprises--.

Signed and Sealed this

Twenty-ninth Day of May, 1990

*Attest:*

HARRY F. MANBECK, JR.

*Attesting Officer*

*Commissioner of Patents and Trademarks*